US012617737B1

(12) United States Patent
Panchal et al.

(10) Patent No.: US 12,617,737 B1
(45) Date of Patent: May 5, 2026

(54) CONTINUOUS PROCESS FOR PRODUCING EXPLOSIVE COMPOSITIONS

(71) Applicant: U.S. Government as Represented by the Secretary of the Army, Dover, NJ (US)

(72) Inventors: Viral Panchal, Parlin, NJ (US); Neha Mehta, Succasunna, NJ (US); Keyur Patel, Dover, NJ (US); Niloufar Faridi, Melville, NY (US); Zohar Ophir, West Orange, NJ (US); Prarthana Manoj Rajai, Pompton Plains, NJ (US); Shiqi Li, Harrison, NJ (US); Tianyi Huang, Ringwood, NJ (US); Mingwan Young, Basking Ridge, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 137 days.

(21) Appl. No.: 18/757,912

(22) Filed: Jun. 28, 2024

Related U.S. Application Data

(60) Provisional application No. 63/524,239, filed on Jun. 30, 2023.

(51) Int. Cl.
*C06B 21/00* (2006.01)
*C06B 45/10* (2006.01)

(52) U.S. Cl.
CPC ..... *C06B 21/0008* (2013.01); *C06B 45/10* (2013.01)

(58) Field of Classification Search
None
See application file for complete search history.

(56) References Cited

U.S. PATENT DOCUMENTS 4,614,146 A * 9/1986 Ross ..... F42D 1/10 366/40
6,417,290 B1 * 7/2002 Ampleman ..... C08G 63/912 149/19.5

(Continued)

FOREIGN PATENT DOCUMENTS

DE 102012103565 10/2013
DE 102012106872 11/2013
DE 1021012108261 1/2014

(Continued)

OTHER PUBLICATIONS

Kunkel, Roland, "A Clever Alternative", Process Worldwide, pp. 28-29, May 2010.

(Continued)

*Primary Examiner* — Aileen B Felton
(74) *Attorney, Agent, or Firm* — Smit Kapadia

(57) ABSTRACT

A continuous mixing technology is used to develop a continuous process as an alternative manufacturing technology to sigma-blade batch mixer process for producing flexible explosive formulations (e.g. Flex-X) that is composed of energetic solids and additives without any solvents. This continuous mixer's chamber is partially filled under atmospheric pressure with significant overhead space, reducing energetic hazards. The continuous mixing machine can be comprised with one or two temperature zones, wherein all ingredients are added subsequently into the mixing chamber.

7 Claims, 3 Drawing Sheets

(56) References Cited

U.S. PATENT DOCUMENTS

| | | | | |
|---|---|---|---|---|
| 11,780,141 | B1 | 10/2023 | Toannidis et al. | |
| 2014/0227548 | A1* | 8/2014 | Myrick | C10L 1/28<br>203/40 |

FOREIGN PATENT DOCUMENTS

| | | | |
|---|---|---|---|
| EP | 0804278 | B1 | 7/1996 |
| EP | 0853491 | | 10/1997 |
| EP | 1436073 | | 5/2003 |
| EP | 1078682 | | 8/2003 |
| EP | 102009010393 | | 1/2010 |
| EP | 2328677 | | 4/2010 |
| EP | 2780510 | | 5/2013 |

OTHER PUBLICATIONS

"Swiss Expertise in High Viscosity Processing", Mixing & Kneading Machinery, pp. 30-32.

* cited by examiner

CONTINUOUS PROCESS FOR PRODUCING EXPLOSIVE COMPOSITIONS

CROSS-REFERENCE TO RELATED APPLICATIONS

This application claims priority to U.S. Provisional Application No. 63/524,239, filed Jun. 30, 2023, the entire disclosure of which is hereby incorporated by reference herein

STATEMENT OF GOVERNMENT INTEREST

The inventions described herein may be manufactured, used and licensed by or for the United States Government.

FIELD OF THE INVENTION

The invention relates in general to manufacturing processes and in particular to manufacturing processes for explosive compositions.

BACKGROUND OF THE INVENTION

Currently fielded demolition charges are packaged in two configurations for specific uses. Block demolition charges are produced using multi-batch operations and pre-packaged in rectangular form. These block demolition charges are high explosive charges that are used for general demolition operations, such as cutting, breaching and cratering. Roll demolition charges are also processed using multi-batch operations and are packaged in a circular roll shape and are used for the same operations as block charges. Roll configuration charges can be useful when confronted with irregular shapes.

Currently fielded roll-shaped demolition formulations are pentaerythritol tetranitrate (PETN) based. Such formulations are currently batch processed, mode starting with the mixing of all ingredients (nitramines, binder, plasticizer, etc.) in a blade mixer for certain period of time. Subsequently, the material from the blade mixer is incrementally loaded to a ram press barrel in order to push/extrude the material through a die to obtain the extrudate of the desired configuration (e.g. roll-shaped). However, the current batch processing method described above produces unsuitable results (e.g. sharkskin-like texture on the extrudate surface) when used with alternative flexible explosive (Flex-X) formulations intended to replace PETN based formulations.

Accordingly, improved processes for preparing energetic compositions are provided herein.

SUMMARY OF INVENTION

A first embodiment of the present disclosure includes a continuous process of preparing an explosive composition, the process comprising: feeding an energetic material and a first binder component into a first mixer, wherein the first mixer comprises an enclosed, temperature controlled mixing chamber, at least one rotor shaft along the interior longitudinal axis of the first mixing chamber, and wherein the rotor shaft comprises at least one mixing element fixed to the rotor shaft and wherein a continuous, partially filled volume is maintained throughout the first mixing chamber; mixing the solid energetic material and the first binder component in the first mixer; feeding the product from the first mixing chamber and a second binder component into a second mixer, wherein the second mixer comprises an enclosed, temperature controlled second mixing chamber, at least one rotor shaft along the interior longitudinal axis of the second mixing chamber and wherein the rotor shaft comprises at least one mixing element fixed to the rotor shaft and wherein a continuous, partially filled volume is maintained throughout the second mixing chamber; mixing the product from the first mixing chamber and the second binder component in the second mixer; and extracting the explosive composition from the second mixing chamber.

A second embodiment of the present disclosure includes the process of the first embodiment, wherein the rotor shaft speed in the first mixing chamber is about 10 to about 50 rpm.

A third embodiment of the present disclosure includes the process of any of the first embodiment to the second embodiment, wherein the residence time in the first mixing chamber is about 5 to about 180 minutes.

A fourth embodiment of the present disclosure includes the process of any of the first embodiment to the third embodiment, wherein the rotor shaft speed in the second mixing chamber is about 15 to about 80 rpm.

A fifth embodiment of the present disclosure includes the process of any of the first embodiment to the fourth embodiment, wherein the residence time in the second mixing chamber is about 10 to about 80 minutes.

A sixth embodiment of the present disclosure includes the process of any of the first embodiment to the fifth embodiment, wherein the first mixing chamber is at a temperature of about 20 degrees Celsius to about 40 degrees Celsius.

A seventh embodiment of the present disclosure includes the process of any of the first embodiment to the sixth embodiment, wherein the second mixing chamber is at a temperature of about 20 degrees Celsius to about 55 degrees Celsius.

The invention will be better understood, and further objects, features and advantages of the invention will become more apparent from the following description, taken in conjunction with the accompanying drawings.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. However, the appended drawings illustrate only typical embodiments of the disclosure and are therefore not to be considered limiting of scope, for the disclosure may admit to other equally effective embodiments.

DETAILED DESCRIPTION

Figure 1:
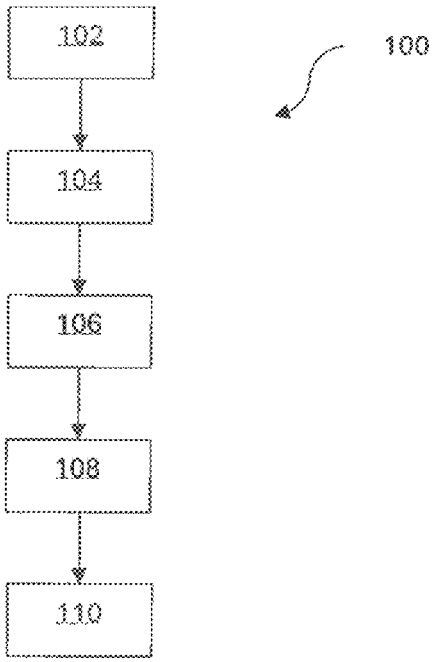
FIG. 1 is a flowchart of a continuous process of preparing an explosive composition in accordance with some embodiments of the present disclosure.
Figure 2:
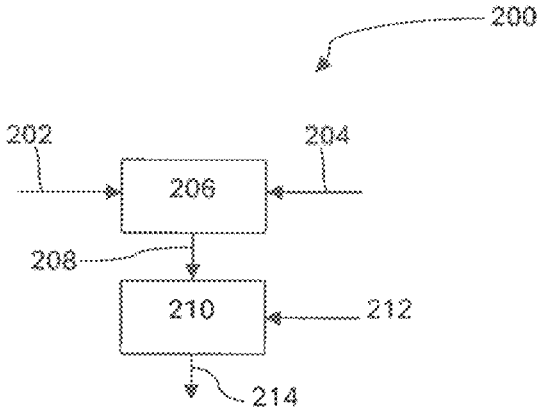
FIG. 2 is a schematic diagram of an exemplary system used for the continuous process of preparing an explosive composition in accordance with some embodiments of the present disclosure.

FIG. 1 depicts a flowchart of a continuous process 100 of preparing an explosive composition in accordance with some embodiments of the present disclosure. The method 100 is described herein with respect to the schematic of the exemplary apparatus 200 depicted in FIG. 2. In embodiments, the method 100 begins at 102 by feeding an energetic material 202 and a first binder component 204 into a first mixer 206. In embodiments, at 104, the energetic material 202 and the first binder component 204 are mixed in the first mixer 206. In embodiments, the energetic material 202 and the first binder component 204 are mixed to form a homogenous mixture. In embodiments, at 106, the product 208 from the first mixer 206 and a second binder component 212 is fed into a second mixer 210. In embodiments, at 108, the product 208 from the first mixer 206 and the second binder component 212 are mixed in the second mixer 210. In embodiments, the product 208 from the first mixer 206 and the second binder component 212 are mixed to form a homogenous mixture. In embodiments, the first binder component 204 and the second binder component 212 are part of a two-part thermoset/reactive binder system. In embodiments, at 110, the explosive composition 214 is extracted from the second mixer.

In embodiments, examples of compositions (composed of energetic solids and additives without any solvents and referred to herein as Flex-X) having suitable energetic material, first binder component, second binder component, and additional additives, for use with the processes and equipment described herein are provided in U.S. patent application Ser. No. 17/692,483 filed on Mar. 11, 2022, and incorporated by reference herein in its entirety.

In such two-part thermoset binder systems, reaction or crosslinking starts after adding a second binder component, which can increase the viscosity of the mixture. Pot life and gel time of the binder systems were achieved by performing rheological testing to determine processing limitations. Pot life is defined as the time at which the viscosity of the material is twice the initial viscosity. As the reaction progresses after adding second binder component, clastic modulus increases and intersects with viscous modulus at the gel point. The elastic modulus is always higher after the gel point, indicating the elastic state of the mixture. The reaction time or pot life of the binder systems can be accelerated while mixing at elevated temperatures.

The materials in the mixing chamber of the mixers 206, 210 are mixed by either one or two rotors, which have rotor shafts connected to mixing elements arranged in a blade configuration that effectively mixes the components while inducing minimal viscous dissipation in the homogeneous viscous mixture. This is achieved by maintaining a low rotor rate so that mild mechanical energy is introduced to the mixture. In a two-rotor configuration, one shaft mixed the mixture while the other cleans the product that can accumulate on the shaft. Improved mixing of the mixture can be achieved by rotating the mixing and cleaning shafts at different speeds. The blades are also tilted slightly forward in order to drag/push the processed stream gradually and in a truncated fashion from the mixing chamber and toward the entrance of a discharge port.

In embodiments, the rotor shaft speed in the first mixing chamber is about 10 rpm to about 50 rpm. In embodiments, the material residence time in the first mixing chamber is about 5 minutes to about 180 minutes. In embodiments, the rotor shaft speed in the second mixing chamber is about 15 rpm to about 80 rpm. In embodiments, the material residence time in the second mixing chamber is about 10 minutes to about 80 minutes. In embodiments, the first mixing chamber is at a temperature of about 20 degrees Celsius to about 40 degrees Celsius. In embodiments, the second mixing chamber is at a temperature of about 20 degrees Celsius to about 55 degrees Celsius.

In embodiments, the first mixer 204 and second mixer 206 is a twin or single shaft continuous mixer with mixing elements (e.g. paddles, hooks, blades, etc.) fixed to the shaft. Suitable mixers for use with the processes described herein are available from LIST™. The machines suitable for use the processes disclosed herein are available in the following patent publications: EP0804278, EP0853491, EP1078682, EP0853491, EP1078682, EP1436073, EP2328677, DE1020090130393, DE102012106872, DE102012103565, DE102012108261, and EP2780510, the contents of which is incorporated by reference herein in its entirety.

Exemplary mixers as described herein fill the gap between low shear devices, such as sigma blade mixers, which provide longer residence time and high shear devices, such as twin-screw extruders (TSE), which provide very short residence time. The exemplary mixers are effective for processing heat sensitive, high viscosity materials, which needs to be mixed and devolatilized efficiently, while generating less shear heating than TSE. The mixing chamber of the exemplary mixer described herein is a partially filled system that operates under an atmospheric pressure, thereby leaving significant overhead space to reduce confinement and increase safety. In contrast, TSE operate under a fully filled chamber where material is confined between the flights/screw pitch that can potentially cause an explosion when processing explosive material. Unlike screws in a TSE, the exemplary mixer described herein mixes an explosive composition under lower shearing forces, lower mechanical stress and the blades of the mixer's two shafts provide fast renewal of material surfaces and efficient self-wiping of material between the blades of the shafts. This mechanism provides optimal mixing without generation of high dissipating shear energy. Additional operational advantages provided by the exemplary mixer described herein include: minimal to no variation from batch to batch, minimal direct human contact during the product run, a limited amount of material in the machine at any given time thereby reducing the accumulation of large quantities of explosive materials at any stage.

A tandem system consisting of LIST kneaders CRP 3.2 and CRP 4C units was used to develop a continuous process as an alternative manufacturing technology to sigma-blade batch mixer process for producing flexible explosive formulations, Flex-X. The LIST kneader machine can be comprised with one or two temperature zones, wherein all ingredients are added subsequently into the mixing chamber.

Mixing of such explosive compositions, which involves simultaneous mixing and reaction within a mixing chamber, can encounter several problems that may affect the efficiency, quality, and safety of the process. Some common issues include: (a) Incomplete Reaction: Inadequate mixing or insufficient residence time within an extruder can result in incomplete chemical reactions, leading to lower yields and compromised product quality. (b) Thermal Degradation: Reactive extrusion often involves high temperatures, which can lead to thermal degradation of the reactants or products, causing undesirable side reactions or changes in molecular structure. (c) Viscosity Control: Reactive systems may undergo significant changes in viscosity during the extrusion process. Poor viscosity control can result in uneven mixing and product inconsistency. (d) Equipment Fouling: Some reaction products or byproducts may adhere to the surfaces of the extruder, leading to fouling and reduced heat transfer efficiency. This can necessitate frequent cleaning and maintenance of the equipment, increasing downtime and production costs. (c) Safety Concerns: Reactive extrusion processes involving hazardous chemicals or high temperatures pose safety risks to personnel and equipment.

Figure 3:
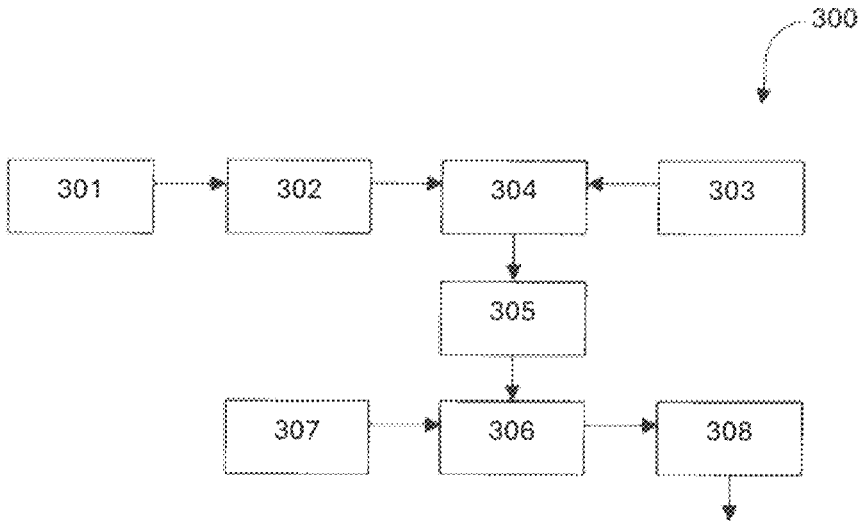
FIG. 3 is a schematic diagram of an exemplary system used for the continuous process of preparing an explosive composition in accordance with some embodiments of the present disclosure To facilitate understanding, identical reference numerals have been used, where possible, to designate identical elements that are common to the figures. The figures are not drawn to scale and may be simplified for clarity. Elements and features of one embodiment may be beneficially incorporated in other embodiments without further recitation.

Example 1: Process Using a System 300, Depicted in FIG. 3 Consisting of Tandem LIST Mixers For reasons of explosive safety, RDX simulant Dechlorane plus (DP515) was used for this example, with average particle size of around 7.4 microns. Silicone based Sylgard 182 (mixed viscosity of 4575 cP) was used as the binder. Pot life and gel time were measured to determine the processing limits.

The solid material was fed into a feed twin screw (FTS) feed hopper 302 using a K-Tron volumetric metering twin-screw feeder 301. In some embodiments, the volumetric feeder may be replaced with a more accurate gravimetric feeder. To compensate for the uneven flow rate of the volumetric feeder, the solid materials were preloaded into plastic containers in batches. Then, based on the desired solid feed rate, the solids were loaded to the K-Tron feeder 301 in seven-minute intervals, thus achieving improved control of the solid feed rate. The FTS 25 302 then picked up the solid material and pushed it through a side port into the top of the LIST mixer 304 (CRP 3.2). The function of the feed hopper was to prevent liquid or gaseous solvent from the CRP process chamber to enter the feed section. Part A of the silicone binder, Sylgard 182 was added directly to the process chamber of the CRP 3.2 304 using a gear pump 303. The gear pump was fed from a pressurized paint tank which was modified for feeding viscous liquids. The CRP 3.2 304 mixing shafts pushed the material into a discharge twin screw (DTS) 25 305, which transported the material to the lower LIST mixer 306 (CRP 4C).

Part B of the Sylgard binder was injected to the mixture by a second gear pump system 307 fed from another pressurized tank after material exited the first twin screw extruder into CRP 4C 306. The product was extracted from the CRP 4C 306 by a discharge twin screw DTS 25 308. Temperature controlled water circulating heaters were connected to both LIST units 304, 306 to make sure the system stayed at room temperature and no temperature increase on the shafts occurred.

The formulation was prepared in the tandem unit described above using Sylgard 182 as the binder over a period of two hours of continuous experimental time, after reaching the steady state conditions. In order to demonstrate the feasibility of using the LIST unit for a continuous process, after calibration of the system, a long run (i.e., 6 hr. run) was conducted and stability of the process was monitored. Samples were collected at each hour in order to measure their mechanical properties and confirm the consistency of the product throughout the 6 hr. run.

In order to reach a steady state process, initially the system was calibrated, i.e., rpms of the CRPs and extruders were changed to obtain equal input and output flow rates. The processing conditions remained stable over the 6 hrs experimental run.

Example 2: Repeat of Example 1, Except that the Binder Material was Replaced with Sylgard 186 (Mixed Viscosity of 66,700 cP) Instead of Sylgard 182. Pot Life and Gel Time were Measured to Determine the Processing Limits Same mixing steps were followed as outlined in example 1. Processing parameters including but not limited to flow rate, temperature, residence time, and mixing elements were optimized within the processing range to prevent a hazardous incident. Due to increased viscosity from the binder, Sylgard 186 material, a slight increase in torque of CRP 4C motor and mixing temperature was noticed.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integer or step. When used herein the term "comprising" can be substituted with the term "containing" or "including" or sometimes when used herein with the term "having".

When used herein "consisting of" excludes any element, step, or ingredient not specified in the claim element. When used herein, "consisting essentially of" does not exclude materials or steps that do not materially affect the basic and novel characteristics of the claim.

In each instance herein any of the terms "comprising", "consisting essentially of" and "consisting of" may be replaced with either of the other two terms.

As used herein, ranges and amounts can be expressed as "about" a particular value or range and when referring to a value is meant to compass the value and variations of the value, such as +10%, or +5%, or +1%. It also is understood that ranges expressed herein include whole numbers within the ranges and fractions thereof. For example, a range of 1000° C. to 1500° C. includes whole number values such as, but not limited to, 1100° C., 1200° C., 1350° C., and 1425° C., and fractions within the range, for example, but not limited to, 1001.25° C., 1234.72° C., 1354.5° C., and 1478.95° C.

While the invention has been described with reference to certain embodiments, numerous changes, alterations and modifications to the described embodiments are possible without departing from the spirit and scope of the invention as defined in the appended claims, and equivalents thereof.

What is claimed is:

1. A process of producing an explosive composition, the process comprising:

feeding an energetic material and a first binder component into a first mixer, wherein the first mixer comprises an enclosed, temperature controlled first mixing chamber, at least one rotor shaft along the interior longitudinal axis of the first mixing chamber, and wherein the rotor shaft comprises at least one mixing element fixed to the rotor shaft and wherein a continuous, partially filled volume is maintained throughout the first mixing chamber;

mixing the solid energetic material and the first binder component in the first mixer;

feeding the product from the first mixing chamber and a second binder component into a second mixer, wherein the second mixer comprises an enclosed, temperature controlled second mixing chamber, at least one rotor shaft along the interior longitudinal axis of the second mixing chamber and wherein the rotor shaft comprises at least one mixing element fixed to the rotor shaft and wherein a continuous, partially filled volume is maintained throughout the second mixing chamber;

mixing the product from the first mixing chamber and the second binder component in the second mixer; and extracting the explosive composition from the second mixing chamber.

2. The process of claim 1, wherein the rotor shaft speed in the first mixing chamber is about 10 rpm to about 50 rpm.

3. The process of claim 1, wherein the residence time in the first mixing chamber is about 5 minutes to about 180 minutes.

4. The process of claim 1, wherein the rotor shaft speed in the second mixing chamber is about 15 rpm to about 80 rpm.

5. The process of claim 1, wherein the residence time in the second mixing chamber is about 10 minutes to about 80 minutes.

6. The process of claim 1, wherein the first mixing chamber is at a temperature of about 20 degrees Celsius to about 40 degrees Celsius degrees Celsius.

7. The process of claim 1, wherein the second mixing chamber is at a temperature of about 20 degrees Celsius to about 55 degrees Celsius.

* * * * *